United States Patent [19]

Mayama

[11] Patent Number: 5,007,170

[45] Date of Patent: Apr. 16, 1991

[54] SCISSORS FOR BOTH RIGHT AND LEFT HAND USE

[75] Inventor: Tatsushige Mayama, Osaka, Japan

[73] Assignee: NT Incorporated, Osaka, Japan

[21] Appl. No.: 513,019

[22] Filed: Apr. 25, 1990

Related U.S. Application Data

[62] Division of Ser. No. 363,880, Jun. 9, 1989, abandoned.

[51] Int. Cl.[5] ..... B26B 13/20

[52] U.S. Cl. ..... 30/232

[58] Field of Search ..... 30/197, 226, 231, 232, 30/252, 256, 298

[56] References Cited

FOREIGN PATENT DOCUMENTS 2014502 8/1979 United Kingdom ..... 30/256

*Primary Examiner*—Douglas D. Watts

*Attorney, Agent, or Firm*—Griffin Branigan & Butler

[57] ABSTRACT

Scissors for both right and left handed use include a front blade and a rear blade which are connected so that they may slidably pivot in relation to each other. A front handle and a rear handle are connected to front and rear blades, respectively, in such a manner that a finger receiving portion on each of the front and rear handles is allowed to take an upper or lower position, alternatively. With the finger receiving portion on the front handle taking the upper position while the finger receiving portion on the rear handle takes the lower position or vice versa, the scissors can cut with the opposing upper and lower cutting edges of the front and rear blades, respectively, or with the opposite lower and upper cutting edges of the front and rear blades respectively.

5 Claims, 8 Drawing Sheets

SCISSORS FOR BOTH RIGHT AND LEFT HAND USE

This is a division of application Ser. No. 07/363,880, filed June 9, 1989.

FIELD OF INVENTION

The present invention relates to improvements in scissors which can cut an object, such as paper, cloth or the like, with opposing upper and lower cutting edges of two pivoting blades.

BACKGROUND OF THE INVENTION

Scissors for cutting paper, cloth or the like are well known in the art. Generally, such scissors are designed specifically for use by a right handed or a left handed person and it is difficult for a left handed person to use right handed scissors or for a right handed person to use left handed scissors. While right handed scissors are readily available in the market place, it is much more difficult to find left handed scissors.

SUMMARY OF THE INVENTION

A primary object of the invention is to provide scissors suitable for both right and left handed use.

Scissors according to the present invention are characterized in that the scissors comprise a front blade having upper and lower cutting edges, a rear blade having upper and lower cutting edges, a connecting means which connects the front and rear blades in such a manner that the front and rear blades are allowed to slidably pivot in relation to each other, a front handle secured to the front blade in such a manner that a finger receiving portion on the front handle is allowed to take an upper or lower position alternatively, and a rear handle secured to the rear blade in such a manner that a finger receiving portion on the rear blade is allowed to take an upper or lower position alternatively.

For right handed use, the finger receiving portion on the front handle takes the upper position while the finger receiving portion on the rear handle takes the lower position. The thumb of the right hand is inserted into the finger receiving portion on the front handle while fingers other than the thumb are placed in the finger receiving portion on the rear handle. As the front and rear handles are moved up and down, the front and rear blades correspondingly pivot on the connecting means so that an object, such as cloth, paper or the like, placed between the front and rear blades, is cut with the upper and lower edges of the front and rear blades respectively.

On the other hand, for left handed use, the finger receiving portion on the front handle takes the lower position while the finger receiving portion on the rear handle takes the upper position. Fingers other than the thumb of the left hand are inserted into the finger receiving portion on the front handle while the thumb of the left hand is placed in the finger receiving portion on the rear handle. When the front and rear handles are moved up and down, the front and rear blades correspondingly pivot on the connecting means so that the object placed between the front and rear blades is cut with the lower and upper cutting edges of the front and rear blades, respectively.

The scissors according to the present invention provide several advantages over conventional scissors. The present invention is for both right and left handed use since the scissors include the front blade, the rear blade, the connecting means, the front handle and the rear handle, with the front and rear blades each having the upper and lower cutting edges, and further the finger receiving portion on each of the front and rear handles can take an upper or lower position alternatively. Since the finger receiving portion on each of the front and rear handles can take an upper or lower position, the scissors can be "folded" to be more compact when not in use. A pair of the opposing upper and lower cutting edges in right handed use can be different in shape from the other pair in left handed use so that the scissors prepared for right and left handed use can be employed for different purposes.

Other objects and advantages of the invention will become apparent upon consideration of the following description, and the accompanying drawings.

DESCRIPTION OF THE PREFERRED EMBODIMENT

Figure 26:
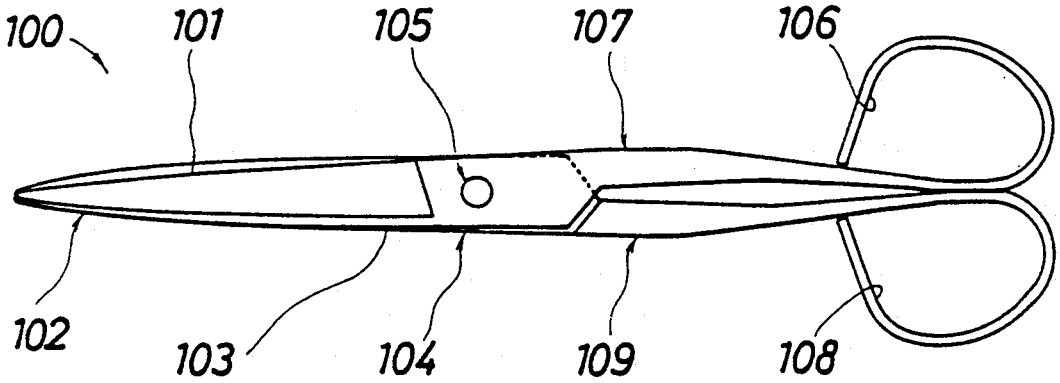
FIG. 26 PRIOR ART
FIG. 26 is a front view of conventional scissors solely for right handed use; and, FIG. 27 is a front view of conventional scissors solely for left handed use.
Figure 27:
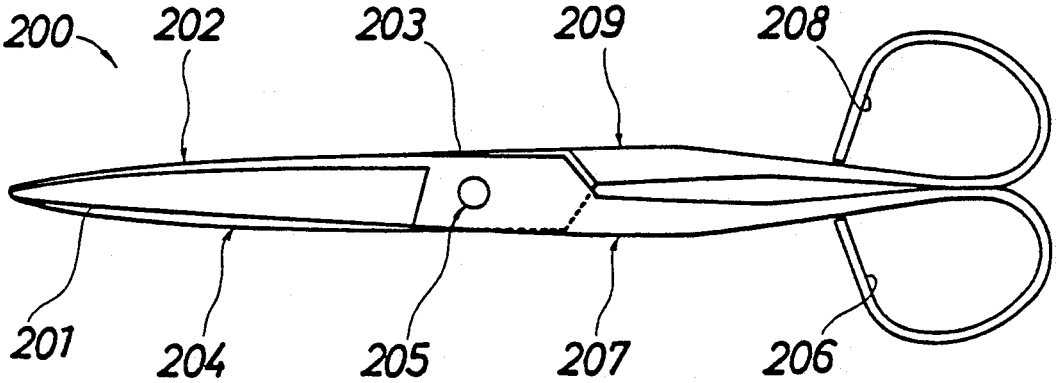
FIG. 27 PRIOR ART

FIGS. 26 and 27 illustrate prior art scissors of conventional design. The scissors 100 shown in FIG. 26 are exclusively for right handed use, and comprise a front blade 102 having an upper cutting edge 101, a rear blade 104 having a lower cutting edge 103, a connecting means 105 which connects the front and rear blades 102, 104 in such a manner that the front and rear blades 102, 104 are allowed to slidably pivot in relation to each other, a front handle 107 integrally connected to the front blade 102 with a hand receiving portion 106 always taking an upper position, and a rear handle 109 integrally connected to the rear blade 104 with a hand receiving portion 108 always taking a lower position.

The scissors 200 shown in FIG. 27 are exclusively for left handed use, and comprise a front blade 202 having a lower cutting edge 201, a rear blade 204 having an upper cutting edge 203, a connecting means 205 which connects the front and rear blades 202, 204 in such a manner that the front and rear blades 202, 204 are allowed to slidably pivot in relation to each other, a front handle 207 integrally connected to the rear blade 204 with a hand receiving portion 208 always taking an upper position.

FIGS. 1 to 7 illustrate a first embodiment of the present invention wherein scissors 1 comprise a front blade 2, a rear blade 3, a connecting means 4, a front handle 5 and a rear handle 6. The front blade 2 has upper and lower cutting edges 7 and 8. The front blade 2 is made from steel used for making cutting tools and roughly in the shape of an elongated triangle. The front blade 2 has on the uppermost side the upper cutting edge 7 which runs down to the tip of the blade 2 and on the lowermost side the lower cutting edge 8 which also extends to the tip of the blade. The rear blade 3 has the same shape as the front blade 2, but is placed reversely. The rear blade 3 has on the uppermost and lowermost side the upper and lower cutting edges 9 and 10 respectively which extend to the tip of the blade.

The connecting means 4 links the front and rear blades 2 and 3 so that the front and rear blades are allowed to slidably pivot in relation to each other. The connecting means 4 comprises an opening (not shown) extending through the backward portion the front blade 2, an internally threaded opening (not shown) extending through the corresponding backward portion of the rear blade 3, and a threaded screw 11 which engages with the openings.

The front handle 5 is secured to the front blade 2, permitting a finger receiving portion 12 on the front handle 5 to take an upper or lower position, alternatively. The front handle 5 comprises a steel bar 13 which is positioned longitudinally relative to the front blade 2 and whose forward end portion is welded to the front side of the backward end portion of the front blade 2. A groove 14 is provided circumferentially at both the forward end and backward end portions of the bar 13. Front handle 5 further comprises a finger holding means 15 which is a semicircle, made from synthetic resin, and provided with a bore 16 at each end of the semi-circular finger holding means 15 for rotatably engaging with the groove 14. The front handle 5 thus has a finger receiving portion 12 in the shape of a half circle formed by the bar 13 and the finger holding means 15. Stoppers 17 are formed on both sides of each end of the finger holding means 15.

The rear handle 6 is secured to the rear blade 3, permitting a finger receiving portion 18 on the rear handle 6 to take an upper or lower position alternatively. The rear handle 6 is substantially the same as the front handle 5 and comprises a steel bar 19 which is positioned longitudinally in relation to the rear blade 3 and whose forward end portion is welded to the rear side of the backward end portion of the rear blade 3 in such a manner that the bar 19 does not interfere with the bar 13, a groove 20 provided circumferentially each at the forward end and backward end portions of the bar 19, a finger holding means 21 which is a semi-circle and made from synthetic resin, a bore 22 which is provided at each end of the semi-circular finger holding means 21 and rotatably engages with the groove 20, the finger receiving portion 18 in the shape of a half circle formed by the bar 19 and the finger holding means 21, and stoppers 23 which are formed on both sides of each end of the finger holding means 21 and one of which is engaged with the opposing stopper 17 on the front handle 5.

Figure 1:
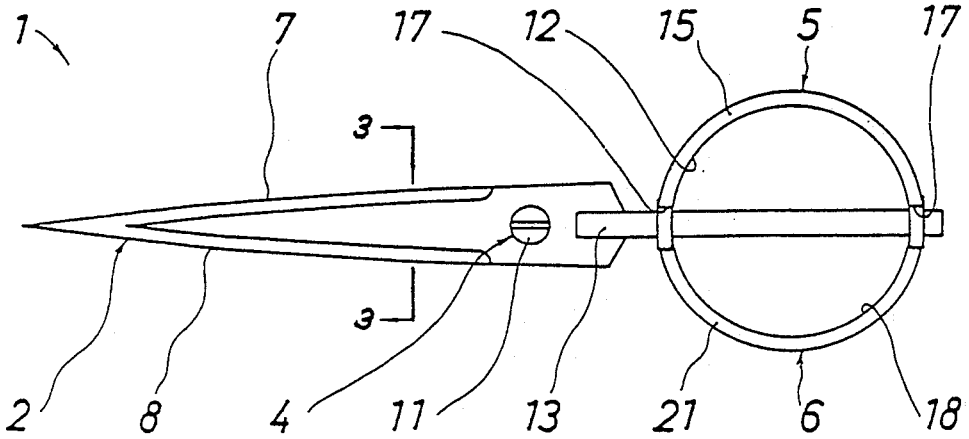
FIG. 1 is a front view of the scissors, prepared for right handed use, according to a first embodiment of the present invention.
Figure 2:
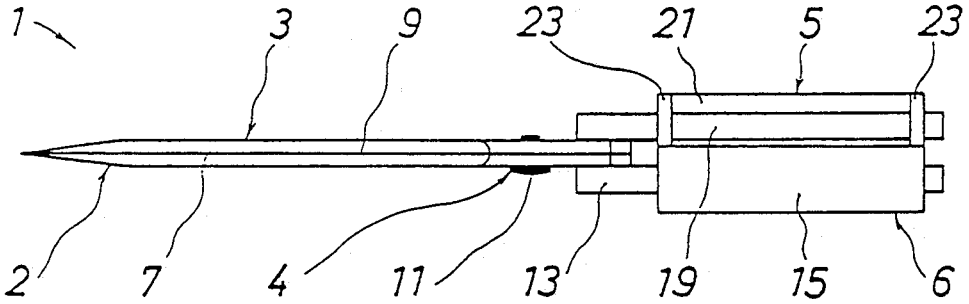
FIG. 2 is a plan view of the scissors of FIG. 1.
Figure 3:
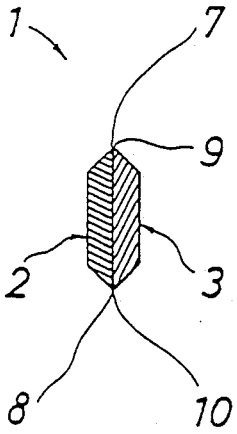
FIG. 3 is a vertical, sectional side view of the scissors taken along the line III—III in FIG. 1.
Figure 4:
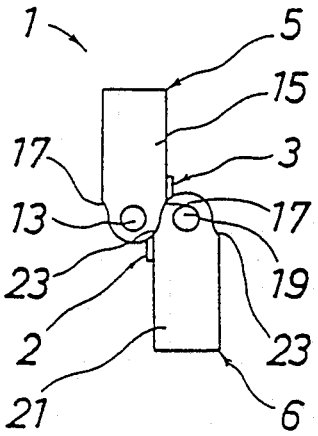
FIG. 4 is a side view of the scissors of FIG. 1.

When the scissors 1 are employed for right handed use, the finger receiving portion 12 of the front handle 5 takes the upper position while the finger receiving portion 18 of the rear handle 6 takes the lower position, as illustrated in FIGS. 1–5. The thumb of the right hand is inserted into the finger receiving portion 12 of the front handle 5 while the fingers other than the thumb are inserted into the finger receiving portion 18 of the rear handle 6. Thereafter, when the front and rear handles 5 and 6 are moved up and down, the front and rear blades 2 and 3 correspondingly pivot on the connecting means 4 so that an object (not shown), such as cloth, paper or the like, placed between the front and rear blades 2 and 3 is cut with the upper and lower cutting edges 7 and 10 of the front and rear blades 2 and 3, respectively. When the front and rear handles 5 and 6 are moved up and down, one of the stoppers 17 of the front handle 5 and the opposing one of the stoppers 23 on the rear handle 6 interfere with each other, as shown in FIG. 4, thereby preventing excessive downward movement of the front handle 5 relative to the rear handle 6.

Figure 6:
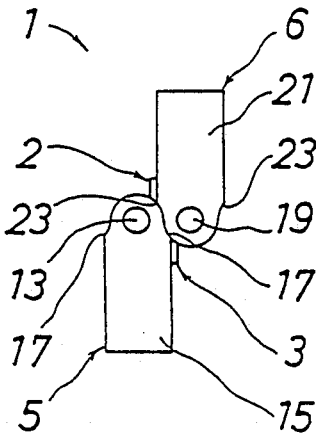
FIG. 6 is a side view of the scissors of FIG. 1 prepared for left handed use.
Figure 5:
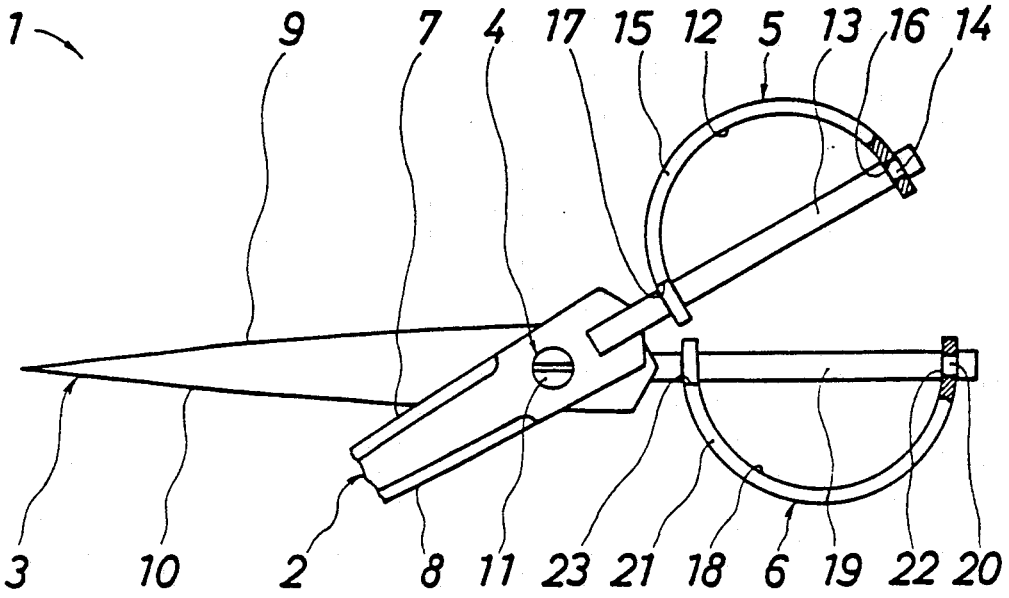
FIG. 5 is a front view of a main part of the scissors in the state of use.
Figure 7:
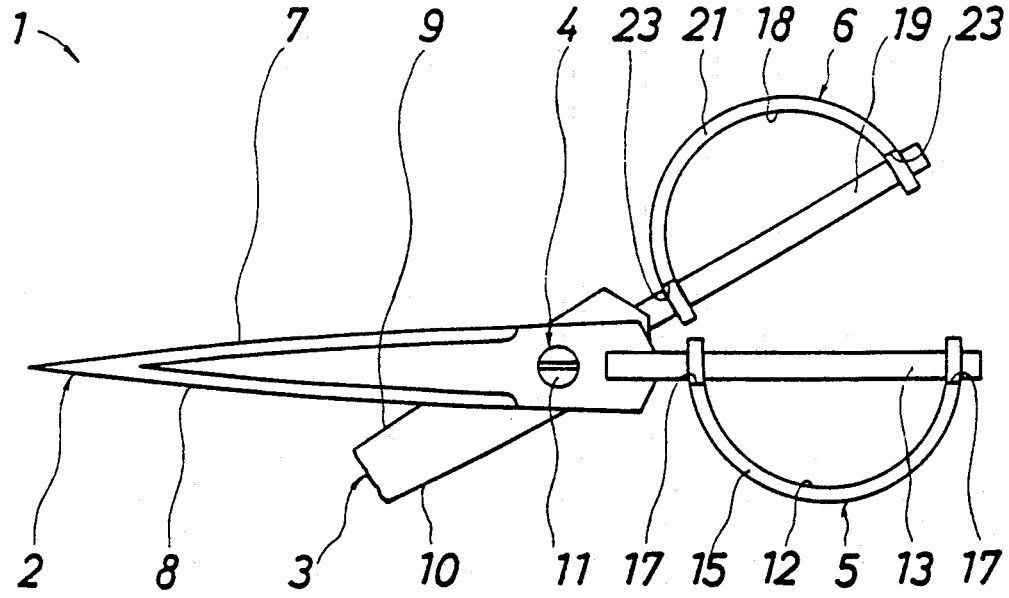
FIG. 7 is a front view of a main part of the scissors of FIG. 6 in the state of use.

On the other hand, when the scissors 1 are to be employed for left handed use, the finger holding means 15 is rotated 180 degrees counter-clockwise (as viewed in FIG. 4) on the bar 13 of the front handle 5 while the finger holding means 21 is rotated 180 degrees counter-clockwise on the bar 19 of the rear handle 6. With these rotations finger receiving portion 12 of the front handle 5 takes the lower position while the finger receiving portion 18 of the rear handle 6 takes the upper position, as shown in FIG. 6 and 7. The fingers of the left hand other than the thumb may be inserted into the finger receiving portion 12 of the front handle 5 while the thumb of the left hand may be inserted into the finger receiving portion 18 of the rear handle 6. As the front and rear handles 5 and 6 are moved up and down, the front and rear blades 2 and 3 correspondingly pivot on the connecting means 4 so that an object placed between the front and rear blades 2 and 3 is cut with the lower and upper cutting edges 8 and 9 of the front and rear blades 2 and 3, respectively.

When the front and rear handles 5 and 6 are moved up and down, one of the stoppers 17 on the front handle 5 and the opposing one of the stoppers 23 on the rear handle 6 interfere with each other, as shown in FIG. 6, thereby preventing excessive downward movement of the rear handle 6 relative to the front handle 5.

Since the finger holding means 15 of the front handle 5 and the finger holding means 21 of the rear handle 6 can pivot relative to the bars 13 and 19, respectively, the finger holding means 15 and 21 can be positioned at an angle which permits a smooth cutting operation when the scissors are in use.

When the scissors 1 are not in use, the finger holding means 21 of the rear handle 6 may be rotated counterclockwise (as viewed in FIG. 4) on the bar 19 so that finger holding means 21 of the rear handle 6 can overlap the finger holding means 15 of the front handle 5. In this manner, scissors 1 can be compacted for storage when not in use.

Figure 8:
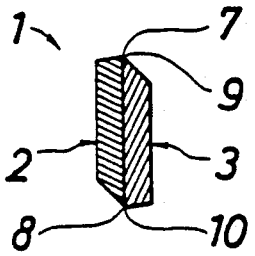
FIG. 8 is a vertical sectional side view of the scissors according to a second embodiment of the present invention.

According to the foregoing embodiment, the upper and lower cutting edges 7 and 8 of the front blade 2 and the upper and lower cutting edges 9 and 10 of the rear blade 3 are all of an acute angle. FIG. 8 shows a second embodiment of the invention wherein the lower cutting edge 8 and upper cutting edge 9 of the front blade 2 and rear blade 3 respectively are of an acute angle while the upper cutting edge 7 and lower cutting edge 10 of the front blade 2 and rear blade 3 are of an obtuse angle. In this manner, the scissors prepared for left handed use can cut paper, cloth or the like while the scissors prepared for right handed use can cut tin-plate, wire or the like. Alternatively, the scissors can be structured so that the scissors can be pinking scissors which can leave a zig-zag cutting trace when prepared for right or left handed use.

The connecting means 4 of the scissors according to the first embodiment of the invention is the screw 11 but obviously, a rivet may be employed instead of a screw.

The front handle 5 of the scissors according to the first embodiment of the invention has the bar 13 secured to the front blade 2 with the finger holding means 15 being rotatably attached to bar 13. However the front handle 5 is not limited to this type of construction but may be constructed as shown in one of FIGS. 9–13.

Figure 9:
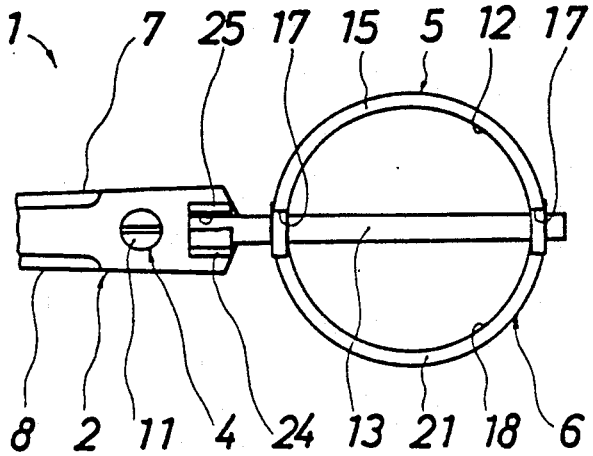
FIG. 9 is a front view of a main part of the scissors according to a third embodiment of the present invention.

According to a third embodiment of the invention as shown in FIG. 9, the finger holding means 15 is secured to the bar 13 while the front blade 2 has a bracket 24 welded thereto which forms an insertion into the opening 25. In this case, the finger receiving portion 12 is allowed to take a required upper or lower position alternatively by rotating the bar 13 at 180 degrees with one end of the bar 13 remaining inserted in the opening 25 or by pulling the bar 13 completely out of the opening 25 and, after turning the bar 13 at 180 degrees, reinserting the bar 13 into the opening 25. In the former case, the scissors can be provided with a means which prevents the bar 13 of the front handle 5 from slipping out and being detached from the front blade 2. In the latter case, the scissors can be provided with a means which prevents the bar 13 from rotating relative to the front blade 2.

Figure 10:
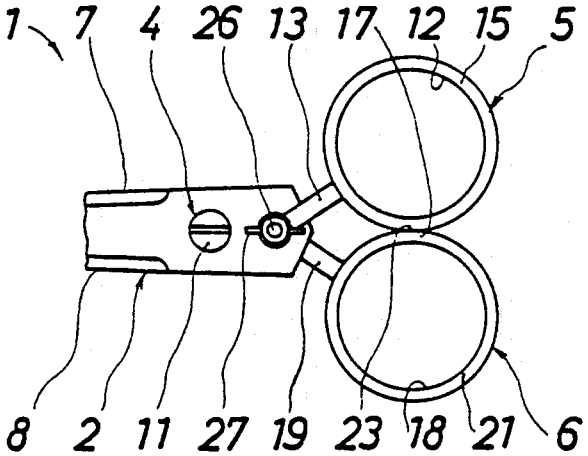
FIG. 10 is a front view of a main part of the scissors according to a fourth embodiment of the present invention.
Figure 11:
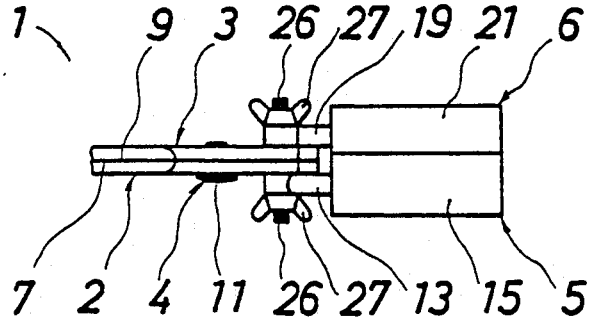
FIG. 11 is a plan view of a main part of the scissors of FIG. 10.

According to a fourth embodiment shown in FIGS. 10 and 11, the finger holding means 15 is secured to the bar 13. The scissors include a screw 26 fastened to the front blade 2, a bore (not shown) running through the bar 13, and a butterfly nut 27 which is engaged with the screw 26 so that the bar 13 may be allowed to pivot relative to the front blade 2.

Figure 12:
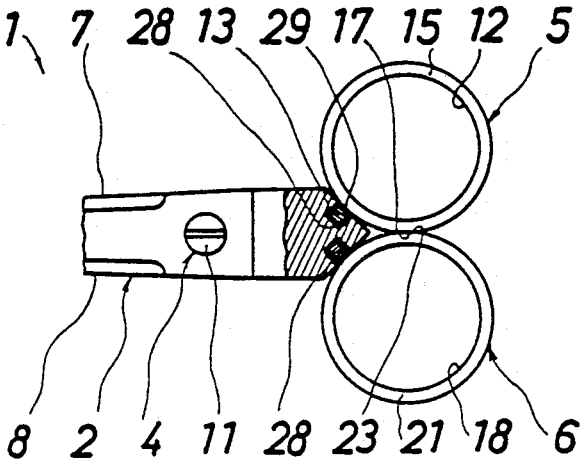
FIG. 12 is a vertical, sectional front view of a main part of a fifth embodiment of the present invention.
Figure 13:
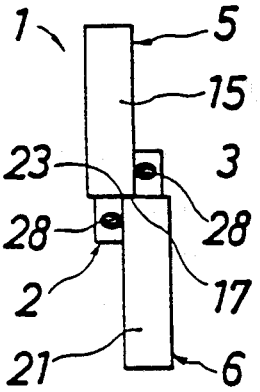
FIG. 13 is a side view of the scissors of FIG. 12.

According to a fifth embodiment shown in FIGS. 12 and 13, the finger holding means 15 is fastened to the bar 13, and the scissors 1 include upper and lower threaded bores 28 provided at the thickened backward end portion of the front blade 2 and a thread 29 cut on the bar 13 to be engaged with one of the bores 28 so that the bar 13 is removably fastened to the front blade 2.

Figure 15:
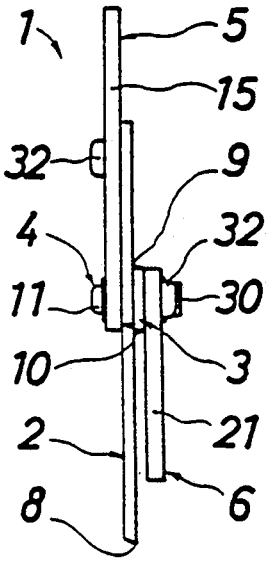
FIG. 15 is a side view of the scissors of FIG. 14.
Figure 14:
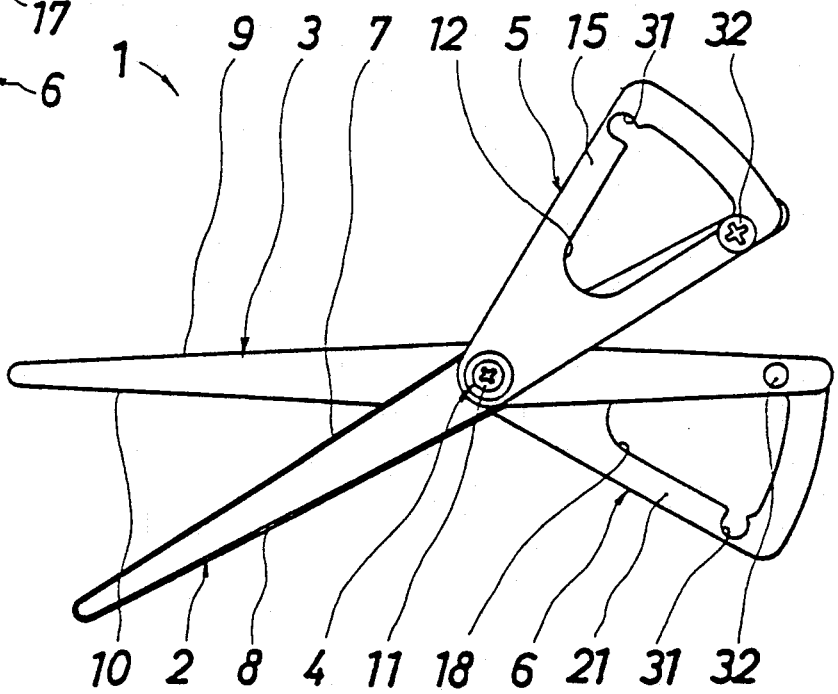
FIG. 14 is a front view of the scissors, prepared for right handed use, in the state of use according to a sixth embodiment of the present invention.
Figure 16:
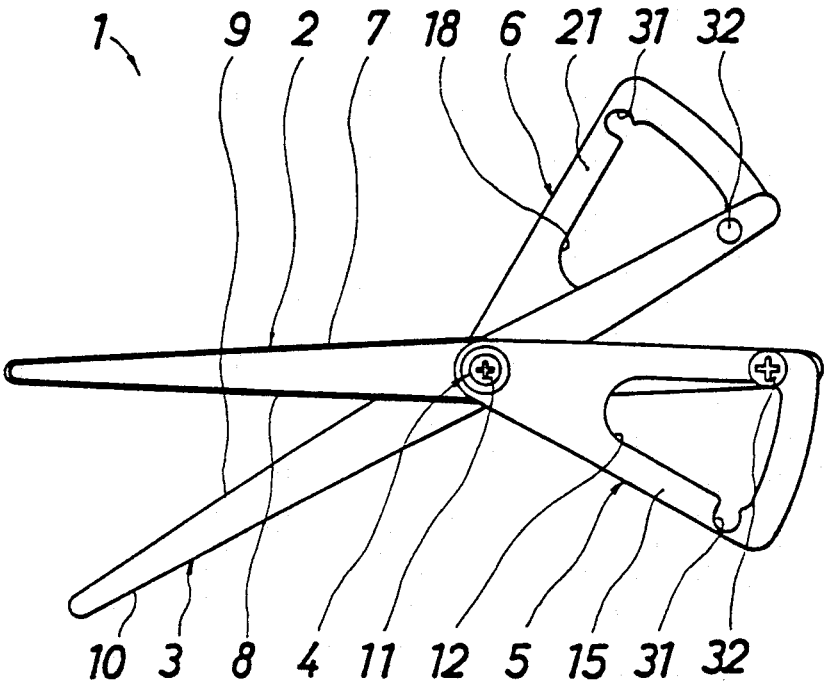
FIG. 16 is a front view of the scissors of FIG. 14, prepared for left handed use, showing the state of use.

According to a sixth embodiment shown in FIGS. 14–16, the finger holding means 15 is roughly in the shape of a triangle and has a bore (not shown) running through the reduced forward end portion thereof. The connecting means 4, which comprises the screw 11 and a nut 30 to be engaged with the screw 11, connects the finger holding means 15 to the front blade 2 in such a manner that the finger holding means 15 is allowed to pivot relative to the front blade 2. The triangular finger holding means 15 has two spaced, upper and lower internally cut-out cavities 31 at the backward end portion thereof. The front blade 2 has a protrusion 32 such as a screw which may be engaged with one of the cavities 31.

Figure 18:
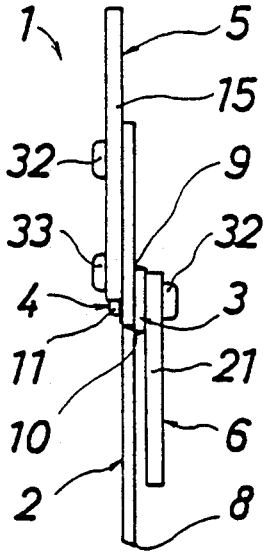
FIG. 18 is a side view of the scissors of FIG. 17.
Figure 17:
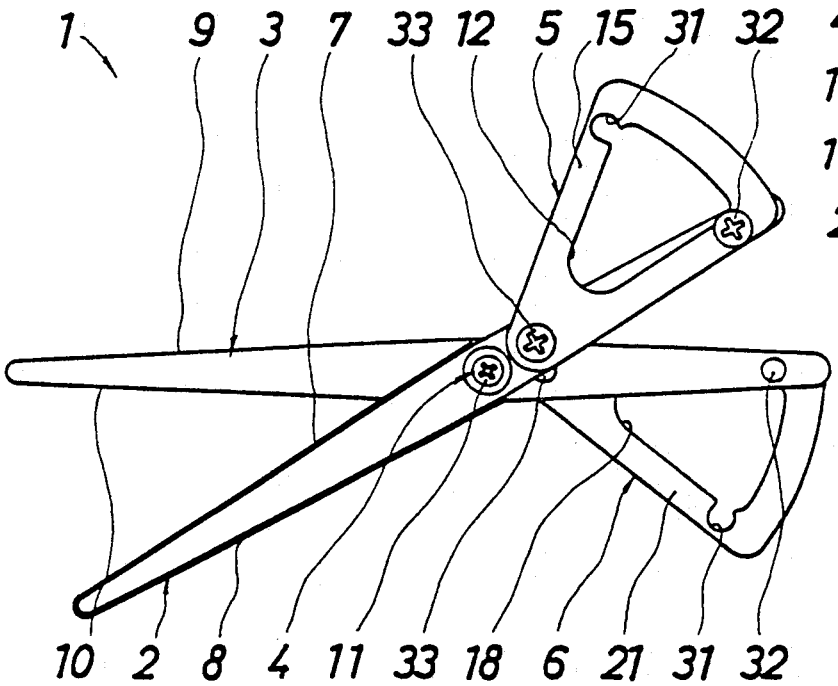
FIG. 17 is a front view of the scissors, prepared for right handed use in the state of use according to a seventh embodiment of the present invention.
Figure 19:
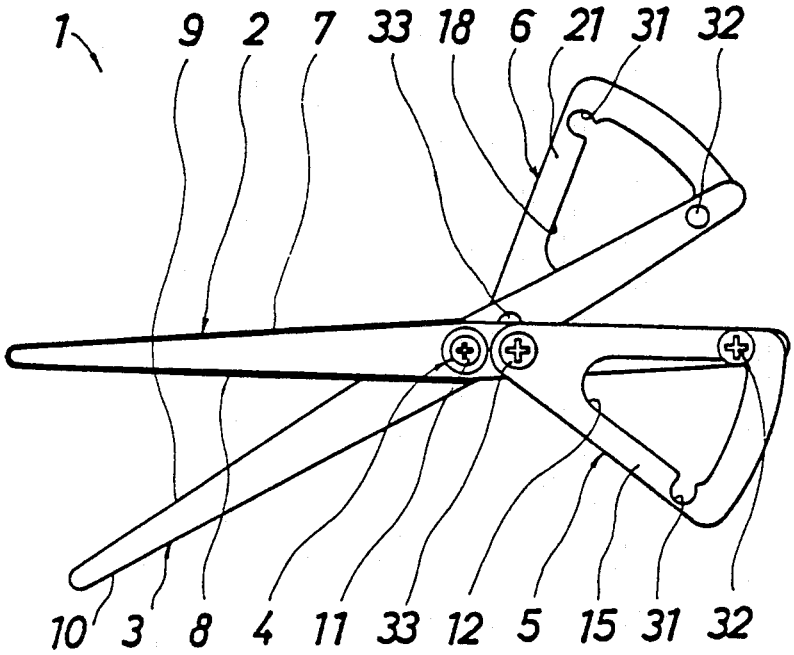
FIG. 19 is a front view of the scissors of FIG. 17, prepared for left handed use, showing the state of use.

According to a seventh embodiment shown in FIGS. 17–19, the finger holding means 15 is roughly in the shape of a triangle and has a bore (not shown) at the reduced forward end thereof. A fastening means 33, not the connecting means 4 as in the sixth embodiment, is engaged with the bore in the triangular holding means 15 for connecting the finger holding means 15 to the front blade 2 in such a manner that the finger holding means 15 is allowed to pivot relative to the front blade 2. The triangular finger holding means 15 has two spaced, upper and lower, internally cut-out cavities 31 at the backward end thereof. The front blade 2 has a protrusion 32, such as a screw, which may be engaged with one of the cavities 31, 31.

Figure 21:
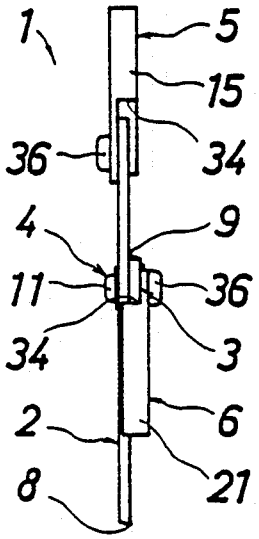
FIG. 21 is a side view of the scissors of FIG. 20, prepared for right handed use, in the state of use according to the eighth embodiment of the present invention.
Figure 20:
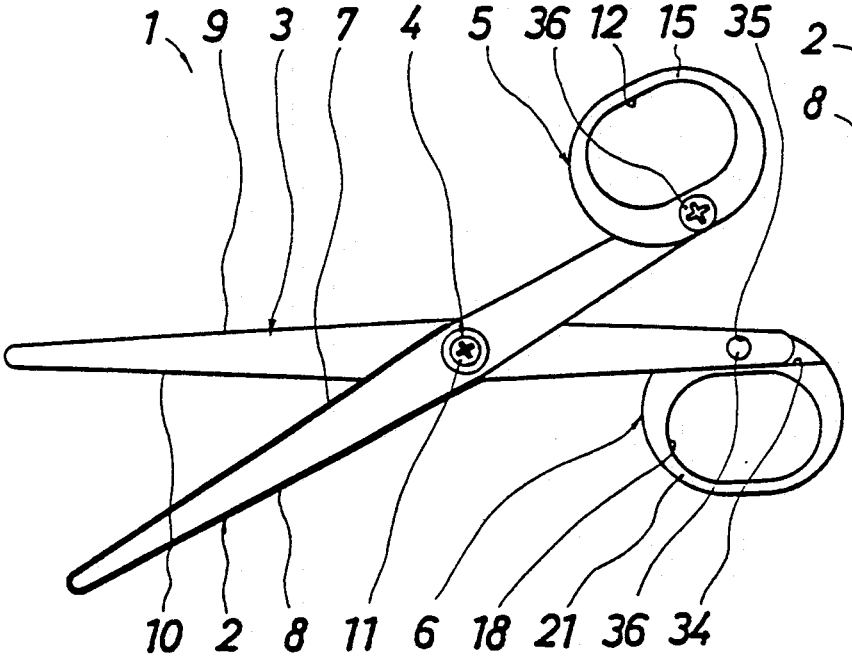
FIG. 20 is a front view of the scissors, prepared for right handed use, in the state of use according to an eighth embodiment of the present invention.
Figure 22:
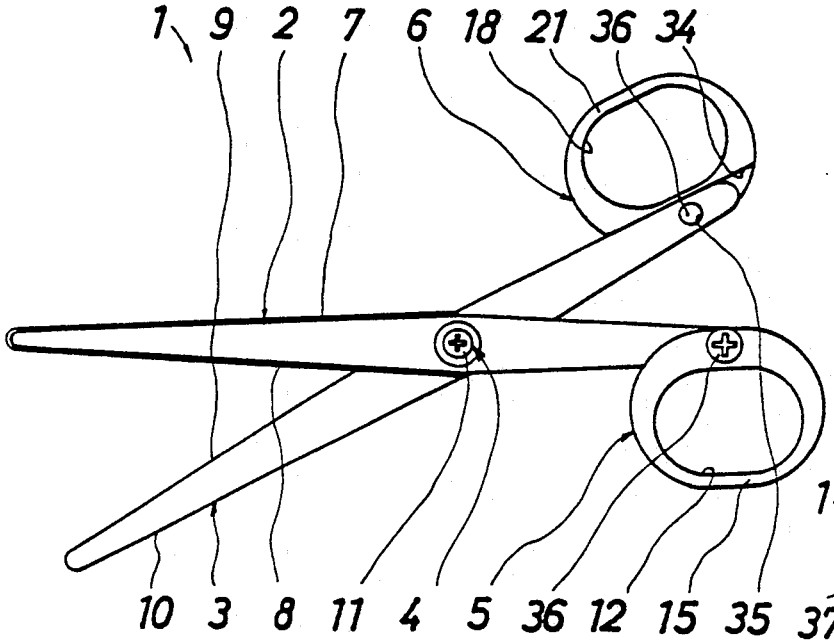
FIG. 22 is a front view of the scissors of FIG. 20, prepared for left handed use, showing the state of use.

According to an eight embodiment shown in FIGS. 20–22, the finger holding means 15 is in the shape of an oval ring. A recess 34 is formed at the upper portion of the finger holding means 15. A bore (not shown) runs through the recess 34 of the finger holding means 15 while a threaded bore 35 runs through the front blade 2. A fastening means 36, such as a screw, is engaged with both the bore in the finger holding means 15 and the threaded bore 35 in the front blade 2 so that the finger holding means 15 is removably and reversibly secured to the front blade 2 by the fastening means 36.

Figure 24:
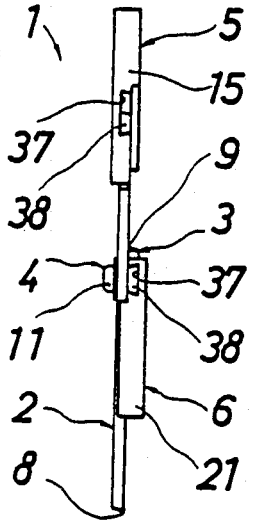
FIG. 24 is a side view of the scissors of FIG. 23.
Figure 23:
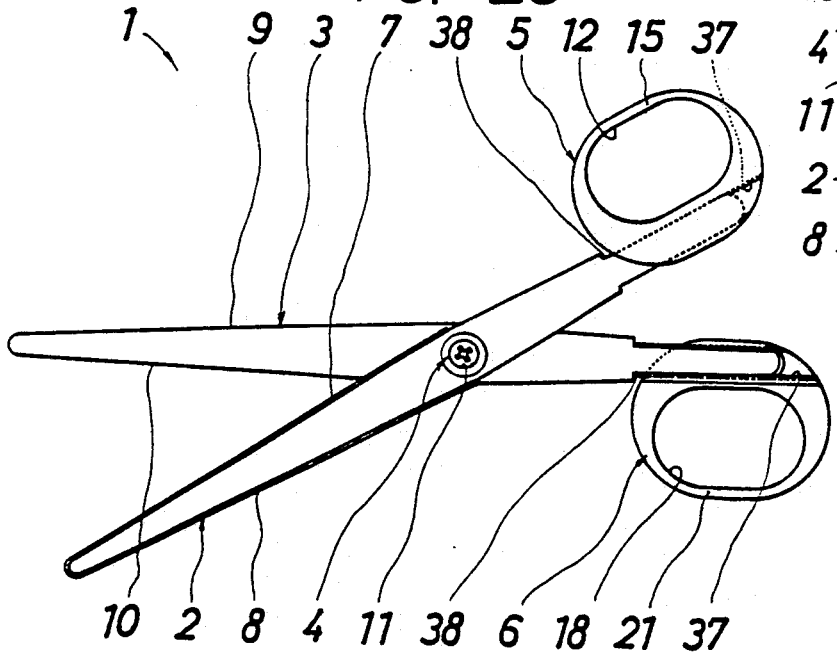
FIG. 23 is a front view of the scissors, prepared for right handed use, in the state of use according to a ninth embodiment of the present invention.
Figure 25:
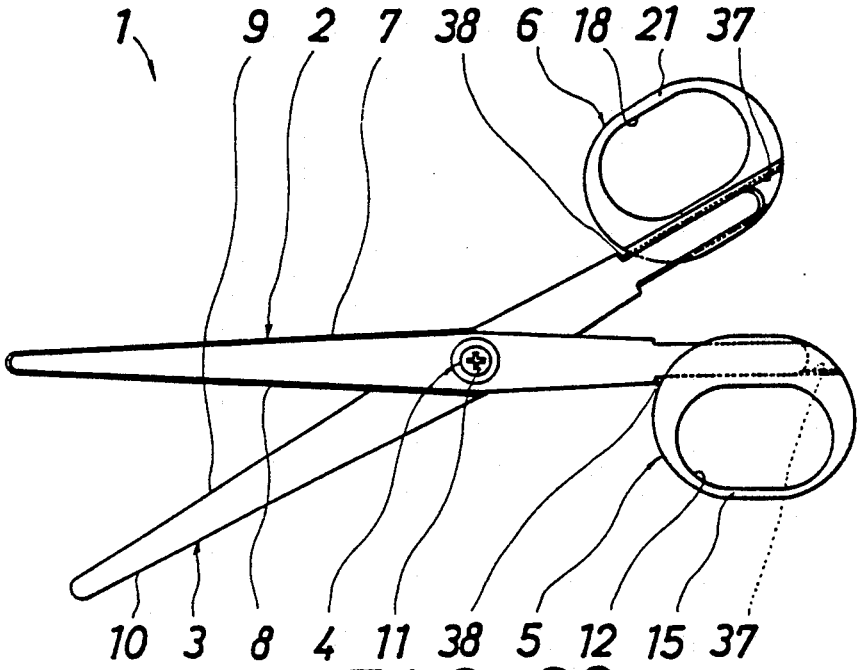
FIG. 25 is a front view of the scissors of FIG. 23, prepared for left handed use.

According to a ninth embodiment shown in FIGS. 23–25, a finger holding means 15 in the shape of an oval ring has a mortise 37 while the front blade 2 has at the backward end thereof a tenon 38 of dovetail cross-section which may be engaged with the mortise 35 so that the finger holding means 15 is removably and reversibly secured to the front blade 2. The front handle 5 is not limited to the semicircular shape in the first embodiment but may be a circle as shown in FIGS. 10–13, a square (not shown) or another shape.

The front handle 5 of the first embodiment has a curved shoulder portion on both sides of each end to form the stopper 17. According to the fourth and fifth embodiments, shown in FIGS. 10–13, a part of the circumferential surface of the finger holding means 15 may serve as the stopper. While preferred embodiments of the invention have been described in specific detail, it will be understood that various modifications and substitutions may be made in the described embodiments without departing from the spirit and scope of the invention as defined by the appended claims.

The embodiment of the invention in which an exclusive property or privilege is claimed are defined as follows.

I claim:

1. Scissors comprising:

a front blade having upper and lower cutting edges;

a rear blade having upper and lower cutting edges;

connecting means pivotally connecting the front blade and the rear blade for slidable pivoting movement relative to each other;

a front handle having a first finger receiving portion thereon, and a rear handle having a second finger receiving portion thereon, characterized in that the connecting means engages not only the front and rear blades but also the front and rear handles so that the front and rear handles and the first and second finger receiving portions provide thereon respectively are pivotal on the connecting means.

2. Scissors as claimed in claim 1 wherein all of the upper and lower cutting edges of the front and rear blades are of an acute angle.

3. Scissors as claimed in claim 1 wherein the lower cutting edge of the front blade and the upper cutting edge of the rear blade are of an acute angle while the upper cutting edge of the front blade and the lower cutting edge of the rear blade are of an obtuse angle.

4. Scissors comprising:

a front blade having upper and lower cutting edges;

a rear blade having upper and lower cutting edges;

a front handle having a first finger receiving portion thereon;

a rear handle having a second finger receiving portion thereon; and, means including a pivot extending through said front and rear blades and said front and rear handles for connecting the front and rear blades for slidable pivoting movement relative to each other and connecting said front and rear handles for pivoting movement relative to said front and rear blades, respectively.

5. Scissors as claimed in claim 4 and further comprising first and second means for limiting pivotal movement of said front and rear handles, respectively, relative to said front and rear blades, respectively.

* * * * *